US006363663B1

(12) United States Patent
Kane et al.

(10) Patent No.: US 6,363,663 B1
(45) Date of Patent: Apr. 2, 2002

(54) POST ENGAGING BRACKETS FOR PARTITIONS

(75) Inventors: Brian J. Kane, San Franciso, CA (US); Alan E. Rheault, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/309,842

(22) Filed: May 11, 1999

(51) Int. Cl.[7] ..... E04B 2/74

(52) U.S. Cl. ..... 52/36.6; 52/36.5; 52/205; 52/239; 52/582.1; 52/656.5; 52/762; 52/770; 52/775

(58) Field of Search ..... 52/36.1, 36.5, 52/36.6, 205, 239, 281, 579, 582.1, 762, 770, 775, 656.5

(56) References Cited

U.S. PATENT DOCUMENTS

| | | | | |
|---|---|---|---|---|
| 995,410 A | | 3/1911 | McClure | |
| 1,911,578 A | * | 5/1933 | Masters | 52/281 X |
| 1,952,749 A | | 3/1934 | Ellis | |
| 2,766,858 A | | 10/1956 | Johnson et al. | |
| 2,981,583 A | | 4/1961 | Eisenberg | |
| 3,162,148 A | | 12/1964 | Ganz | |
| 3,629,960 A | | 12/1971 | Roush | |
| 3,694,975 A | | 10/1972 | Pollock | |
| 3,733,755 A | * | 5/1973 | Butler | 52/36.6 |
| 3,762,116 A | | 10/1973 | Anderson et al. | |
| 3,802,146 A | | 4/1974 | Tacke et al. | |
| 3,908,949 A | | 9/1975 | Larson | |
| 3,966,158 A | | 6/1976 | Boundy | |
| 4,035,972 A | * | 7/1977 | Timmons | 52/241 |
| 4,070,808 A | * | 1/1978 | Danescu | 52/239 X |
| 4,134,439 A | | 1/1979 | Scott | |
| 4,387,872 A | | 6/1983 | Hogue | |
| 4,682,457 A | | 7/1987 | Spencer | |
| 4,852,317 A | | 8/1989 | Schiavello et al. | |
| 4,887,783 A | | 12/1989 | Franklin | |
| 5,033,528 A | | 7/1991 | Volcani | |
| 5,092,253 A | | 3/1992 | Grund et al. | |
| 5,103,741 A | | 4/1992 | Grund et al. | |
| 5,104,087 A | | 4/1992 | Wentzloff et al. | |
| 5,333,665 A | | 8/1994 | Safar | |
| 5,430,984 A | | 7/1995 | Young et al. | |
| 5,746,040 A | * | 5/1998 | Young et al. | 52/775 |
| 5,950,371 A | * | 9/1999 | Rives et al. | 52/36.6 |
| 6,058,667 A | * | 5/2000 | MacDonald et al. | 52/239 |
| 6,115,977 A | * | 9/2000 | Hornberger et al. | 52/239 X |

OTHER PUBLICATIONS

Exhibit A is a picture of stretch fabric panels for tabletops, President Company, Interiors, Jan. 1995.

* cited by examiner

*Primary Examiner*—Beth A. Stephan
*Assistant Examiner*—Brian E. Glessner
(74) *Attorney, Agent, or Firm*—Price, Heneveld, Cooper, DeWitt & Litton

(57) ABSTRACT

A screen assembly is adapted to connect to a partition of the type having at least one upright frame member with openings in opposite side faces thereof to receive support hooks of hang-on accessory units. The screen assembly includes a sheet member defining at least one side edge, and a bracket is connected to the sheet member adjacent the side edge. The bracket includes a first member configured to extend around at least a portion of a first side of the upright frame member. The first member includes a connector adapted to engage the openings in the first side face of the upright frame member. The bracket also includes a second member configured to extend around at least a portion of a second side of the upright frame member. The second member includes a connector adapted to engage openings in a second side face of the upright frame member.

16 Claims, 7 Drawing Sheets

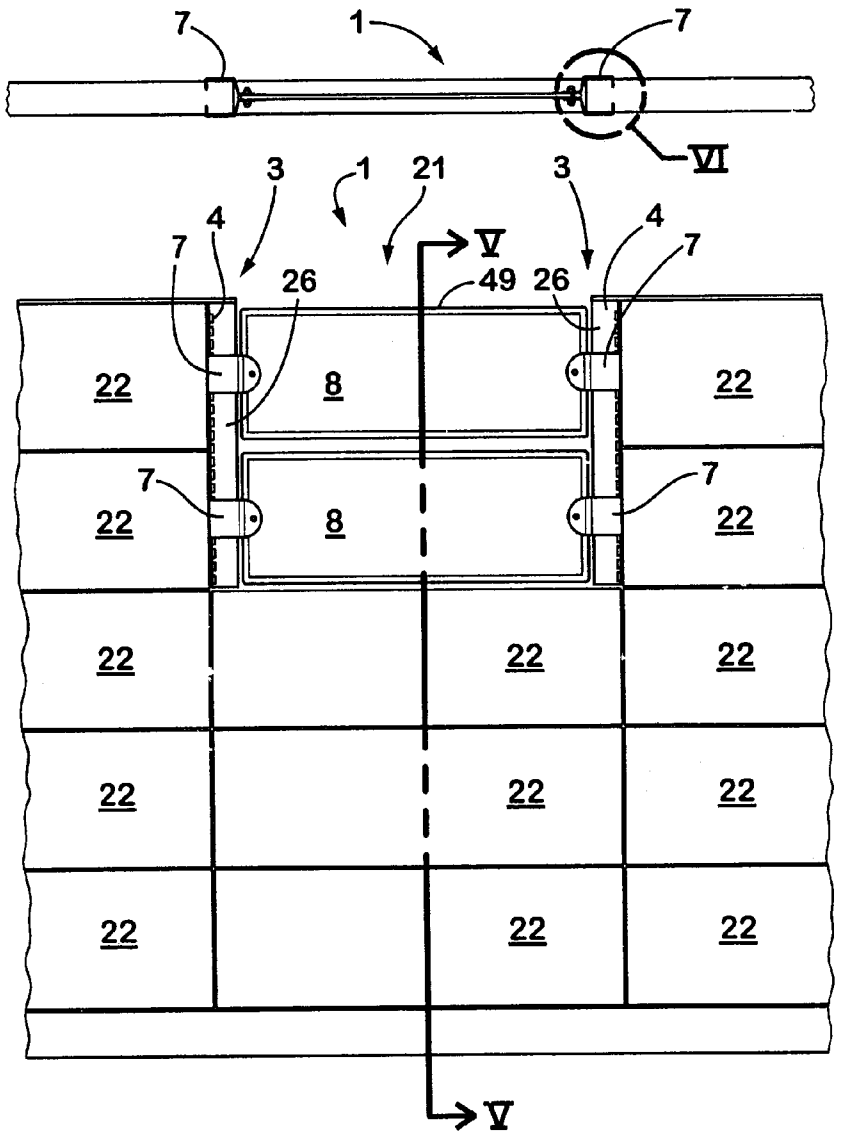
Fig. 4
Fig. 3
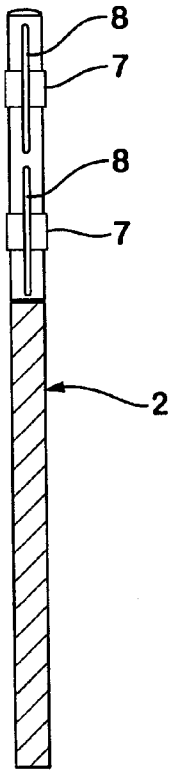
Fig. 5

POST ENGAGING BRACKETS FOR PARTITIONS

BACKGROUND OF THE INVENTION

The present invention relates to a screen including a bracket that engages the vertical row of openings in a slotted upright of an office partition panel system.

The efficient use of building floor space is an ever growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable or portable partition panels that are detachably interconnected to partition off the open spaces into individual workstations and/or offices. Such partition panels have sufficient structural strength to receive hang-on furniture units, such as worksurfaces, overhead cabinets, shelves, etc, and are generally known in the office furniture industry as "systems furniture." The partition panels may include vertical structural members having a vertical row of slots or openings that receive the hooks of hang-on accessory units for support thereof.

One type of partition panel that has been developed in an attempt to accommodate the changing needs of users includes a "stacking" panel that can be positioned above a lower panel to increase the height of an existing partition. Although such stacking panels generally provide increased panel height, stacking panels may be relatively expensive and difficult to install. Accordingly, a need exists for a lightweight screen that can be quickly and easily installed to provide additional privacy for a user of a workspace.

SUMMARY OF THE INVENTION

One aspect of the present invention is to provide a screen assembly adapted to connect to a partition of the type having at least one upright frame member with openings in opposite side faces thereof to receive support hooks of hang-on accessory units. The screen assembly includes a sheet member defining at least one side edge, and a bracket is connected to the sheet member adjacent the side edge. The bracket includes a first member configured to extend around at least a portion of a first side of the upright frame member. The first member includes a connector adapted to engage the openings in the first side face of the upright frame member. The bracket also includes a second member configured to extend around at least a portion of a second side of the upright frame member. The second member includes a connector adapted to engage openings in a second side face of the upright frame member.

Another aspect of the present invention is a knock-down portable partition. The partition includes a partition frame having a pair of spaced-apart vertical posts. Each of the posts has a vertical row of openings in a side face for supporting hang-on accessory units. Upper and lower beams extend between the posts, and rigidly yet releasably interconnect the same to form a rigid panel frame that can be quickly and easily assembled and disassembled. A screen assembly is connected to a first one of the posts. The screen assembly includes a screen member defining at least one side edge. The screen assembly also includes a bracket with at least one connector, the connector engaging the row of openings in post and supporting the screen adjacent the post.

Yet another aspect of the present invention is a door assembly for partitions of the type having at least one upright frame member with at least one row of openings therein for supporting hang-on accessory units. The door assembly includes a door member defining a side edge. A bracket includes at least one connector shaped to be received within the row of openings of an upright frame member. A hinge pivotably interconnects the door member and the bracket member adjacent the side edge of the door member.

These and other features, advantages and objects of the present invention will be further understood and appreciated by those skilled in the art by reference to the following specification, claims and appended drawings.

BRIEF DESCRIPTION OF THE DRAWINGS

FIG. 3 is a fragmentary, front elevational view showing the screen and bracket arrangement of the present invention;

FIG. 4 is a fragmentary, top plan view showing the screen and bracket arrangement of the present invention;

FIG. 5 is a cross-sectional view of the screen and bracket of FIG. 3 taken along the line V—V;

DETAILED DESCRIPTION OF PREFERRED EMBODIMENT

Figure 1:
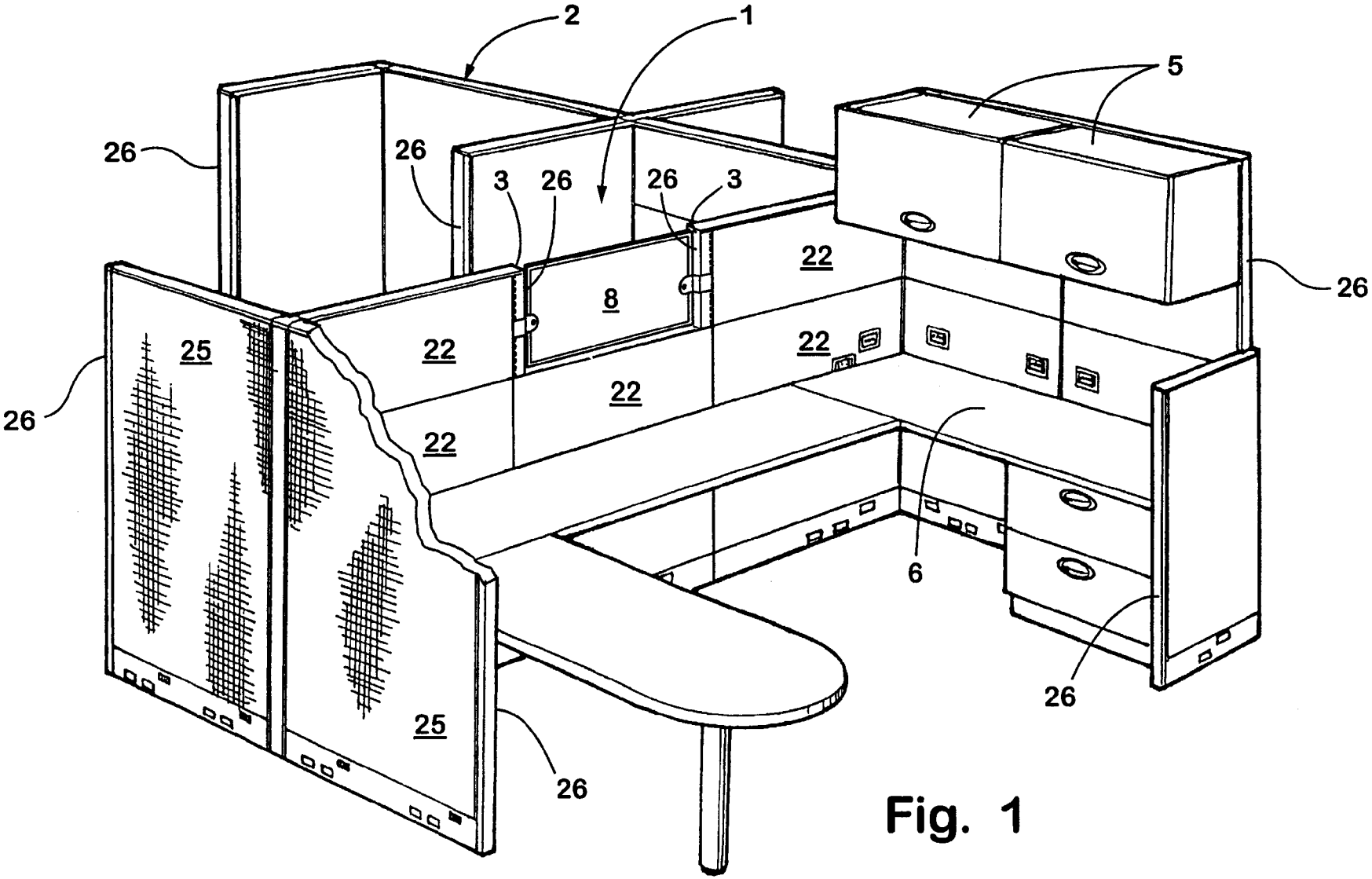
FIG. 1 is a fragmentary, perspective view of a partition system including a screen and bracket arrangement embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
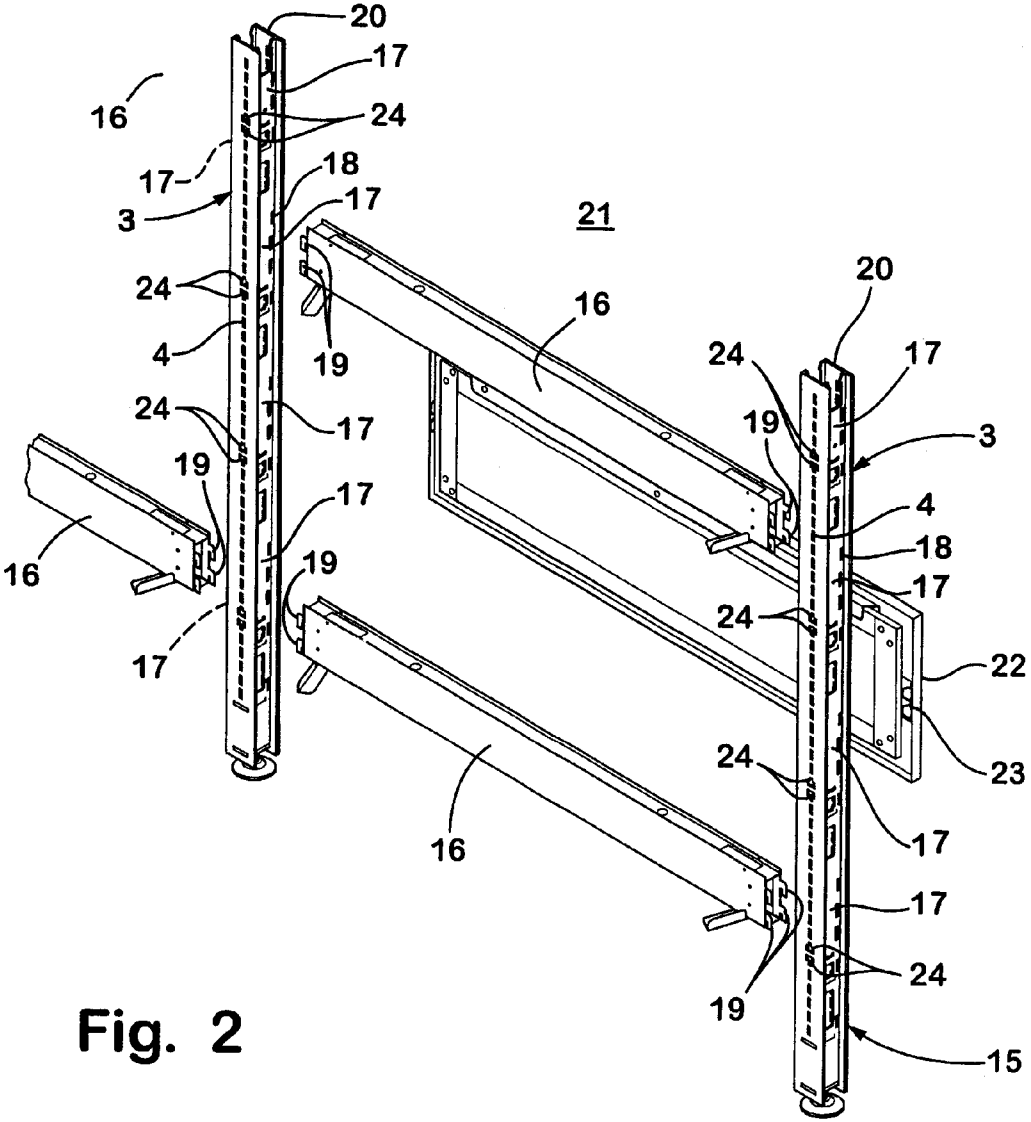
FIG. 2 is a fragmentary, exploded perspective view of the partition frame.

With reference to FIG. 1, the screen assembly 1 of the present invention is adapted to connect to a partition 2 having at least one upright frame member such as a post 3 (see also FIG. 2). The posts 3 include a vertical row of openings 4 that receive support hooks of hang-on accessory unit, such as storage bin 5 or worksurface 6. With further reference to FIGS. 3–6, the screen assembly 1 of the present invention includes a sheet member 8 defining at least one side edge 9. A bracket 7 is connected to the sheet member 8 adjacent the side edge 9 of sheet 8. Bracket 7 includes a first member 10 configured to extend around at least a portion of a first side 11 of an upright post 3. The first member 10 includes a connector such as a hook 12 that engages the openings 4 in the first side 11 of the upright post 3. The bracket also includes a second member 13 configured to extend around at least a portion of a second side face 14 of the post 3. The second member 13 includes a connector, such as a hook 12, that is adapted to engage openings 4 in the second side face 14 of the posts 3.

An example of a partition 2 is described in detail in U.S. Pat. application No. Ser. 09/060,913 filed on Apr. 15, 1998, and entitled KNOCK-DOWN PORTABLE PARTITION SYSTEM, the entire contents of which are hereby incorporated herein by reference. With reference to FIG. 2, partition 2 includes a partition frame 15 having upright posts 3 that are rigidly interconnected by beams 16. Upright posts 3 include a plurality of openings 18 that form beam connection ports 17. Each beam 16 each includes four hooks 19 on opposite ends of the beam 16 that are received within the openings 18 of connection ports 17. Because the posts 3 include a plurality of connection ports 17 located at various heights, the beams 16 can be positioned at the required height for a particular application. For example, the upper beam 16 may be spaced downwardly from the upper ends 20 of the posts 3, thereby forming a generally U-shaped opening 21 through the partition frame 15. U-shaped opening 21 may then receive the screen assembly 1 of the present invention. The partition frame 15 may be covered by either a full-height cover panel 25 (FIG. 1), or a partial height "segmented" cover panel 22. The cover panels include clips 23 that are received within mounting openings 24 in posts 3. At a change-of-height location, or end-of-run location, the posts 3 are covered by a end cap 26. The end cap 26 is also used adjacent the screen assembly 1 of the present invention to cover posts 3 and provide a finished appearance.

Figure 7:
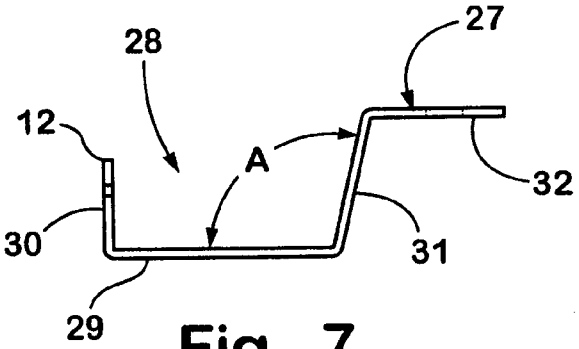
FIG. 7 is a top plan view of the bracket of FIG. 6.
Figure 8:
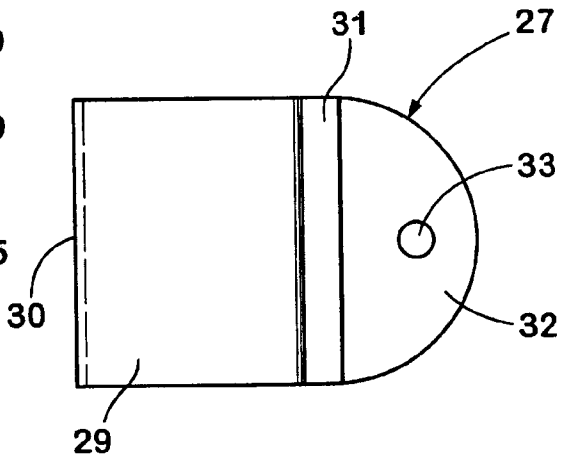
FIG. 8 is a front elevational view of the bracket of FIG. 6.
Figure 9:
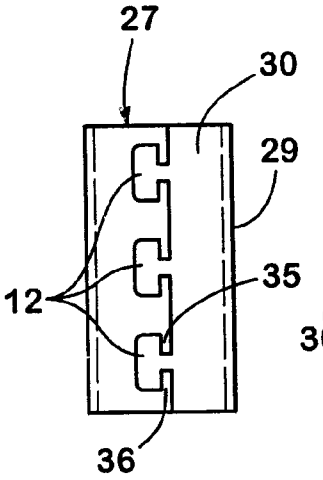
FIG. 9 is a side elevational view of the bracket of FIG. 6.
Figure 6:
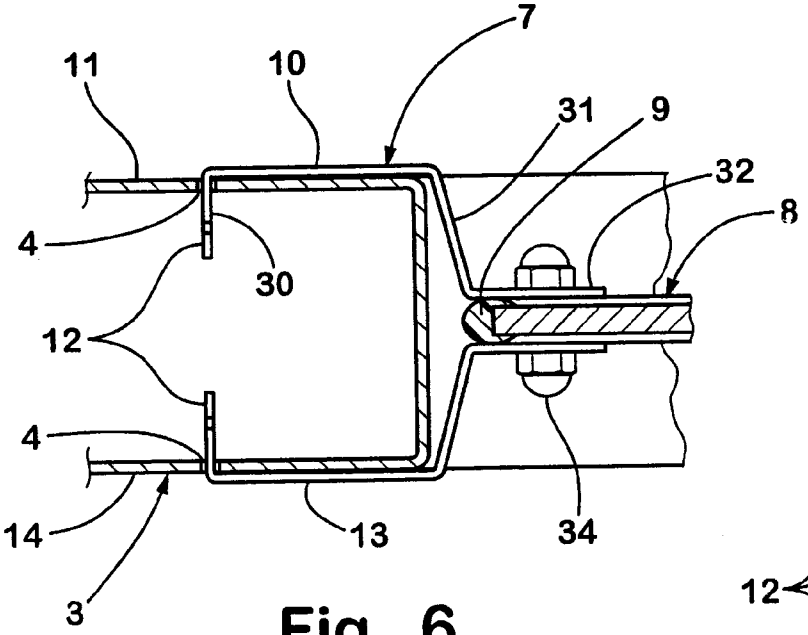
FIG. 6 is a fragmentary view of the bracket of FIG. 4.

With reference to FIGS. 3–4, a pair of screen assemblies 1 may be mounted above one another to provide a "segmented" appearance if the U-shaped opening 21 through the partition 2 is sufficiently large. With further reference to FIGS. 6–9, bracket 7 includes two identical bracket halves 27. The bracket 27 is made from a suitable material, such as sheet metal, and forms a generally U-shape 28 in plan view (FIG. 7). The U-shape 28 is formed by a base or web 29, with first leg of the U-shape forming a flange 30, on which hooks 12 are formed. A second leg forms a sidewall 31 extending away from the web 29 at an angle "A" that is slightly greater than 90°, preferably about 103°. The end portion 32 of the bracket 27 extends over the side edge 9 of the sheet member 8 when assembled, and a threaded fastener 34 extends through the opening 33 in the end portion 32 of bracket 27 to "sandwich" the sheet 8 between the brackets 27. When the threaded fastener 34 is installed and tightened, the brackets 27 are rigidly interconnected, such that the hooks 12 cannot be removed from the post 3. Hooks 12 include both an "upward" cut-out hook 35, and a "downward" cut-out hook 36. This arrangement permits the bracket 27 to be rotated 180° to the required orientation, such that a pair of identical brackets 27 can be used on the opposite sides of the posts 3. Screen 8 is made of a suitable polymer material that could be clear, translucent, frosted, or otherwise treated to provide the desired degree of visibility through the screen 8, depending upon the application. Furthermore, it is anticipated that the screen 8 could be made of a relatively thin hardboard material or the like to provide additional privacy if required.

Figure 11:
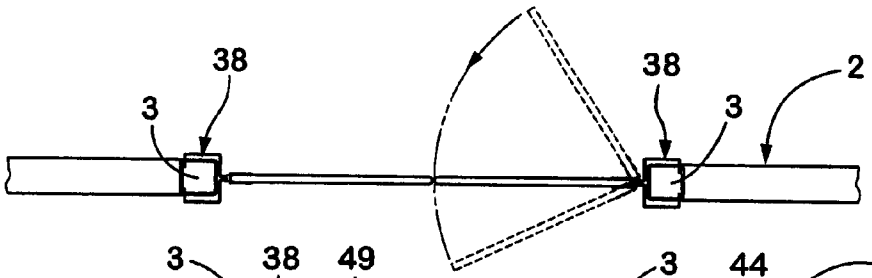
FIG. 11 is a fragmentary, top plan view of the door of FIG. 10.
Figure 10:
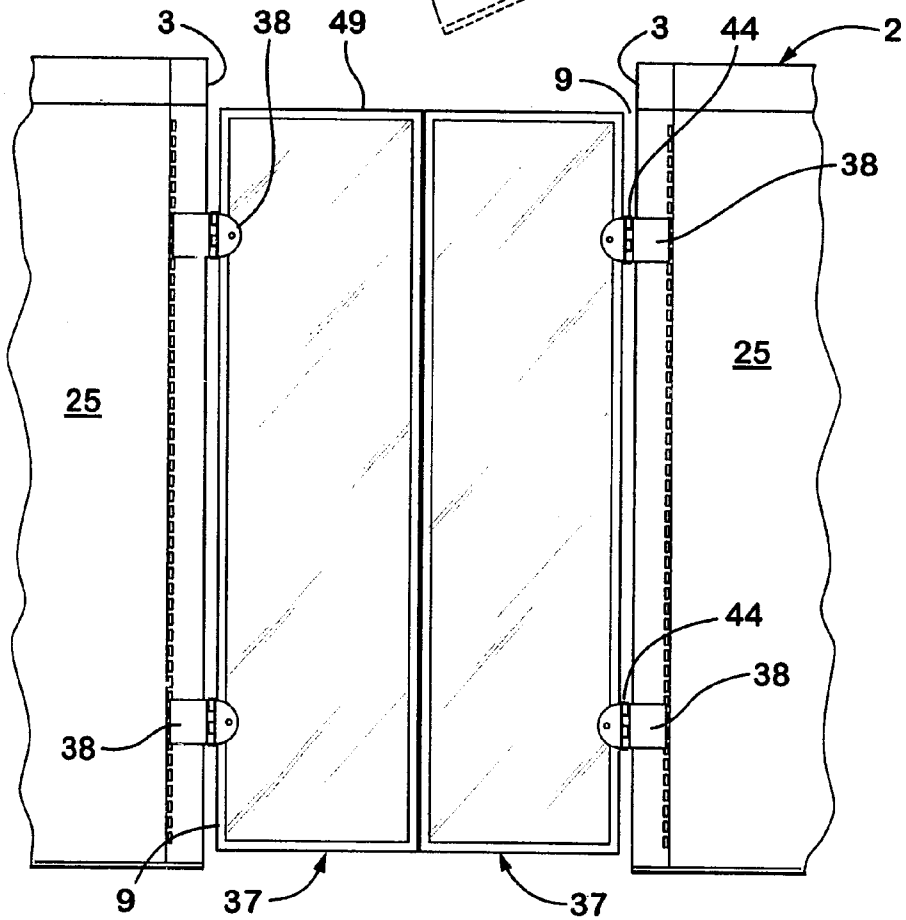
FIG. 10 is a fragmentary, front elevational view of a partition system including a screen that is pivotably connected to a bracket to form a door assembly.
Figure 13:
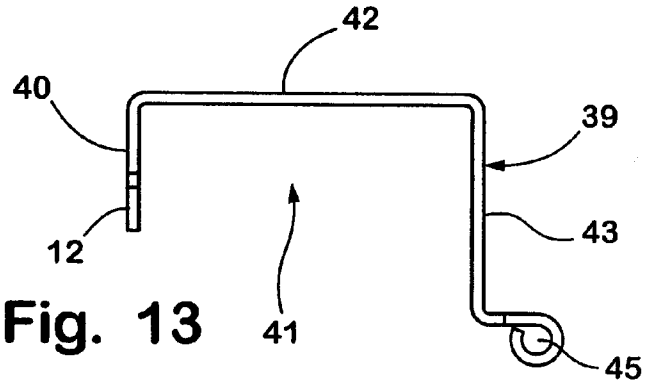
FIG. 13 is a top plan view of the bracket of FIG. 10.
Figure 14:
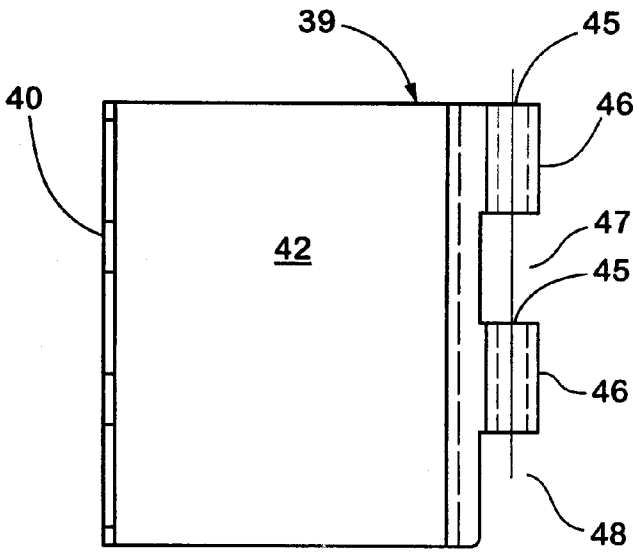
FIG. 14 is a front elevational view of the bracket of FIG. 10.
Figure 15:
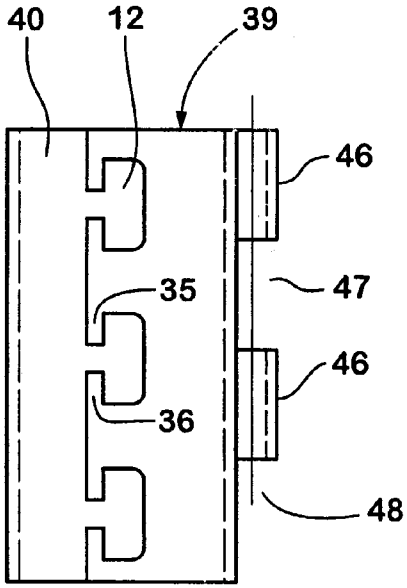
FIG. 15 is side elevational view of the bracket of FIG. 10.
Figure 12:
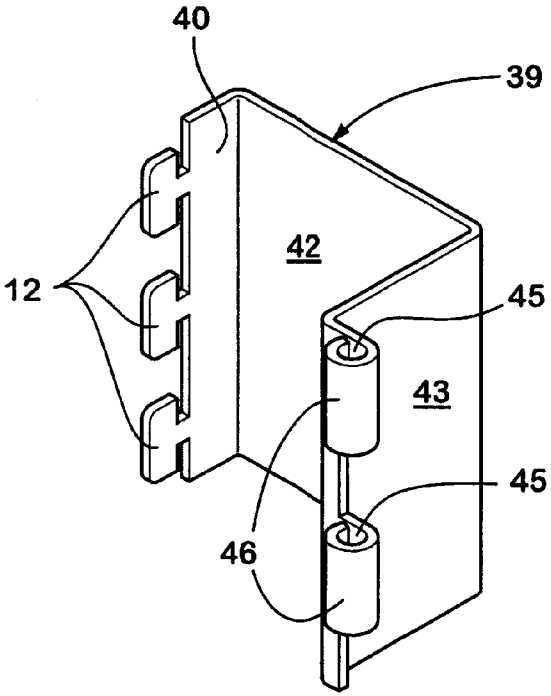
FIG. 12 is a perspective view of the bracket of FIG. 10.

With further reference to FIGS. 10 and 11, a door 37 is secured to the posts 3 by a pair of hinged brackets 38. Hinged bracket 38 includes a pair of identical bracket members 39 illustrated in FIGS. 12–15. The brackets 39 are formed from sheet metal, and include a plurality of hooks 12 formed in the flange 40. Brackets 39 include a base or web 42, flange 40, and sidewall 43 forming a generally U-shape 41 in plan view (FIG. 13). Hooks 12 of bracket 39 include "upward" cut-outs .35, and "downward" cut-outs 36, such that a pair of identical brackets 39 can be used on each side of the posts 3. A pair of spaced-apart curled end portions 46 of the sidewall 43 form openings 45 that received a hinge pin 44 to permit rotation of the screen 8 to form the doors 37. The curled end portions 46 are offset, and form clearances 47 and 48 that receive the curled end portions 46 of the opposite bracket 39 when assembled. An edge frame 49 extends around the perimeter of the sheet 8 to cover the edges thereof if required for a particular application.

Figure 17:
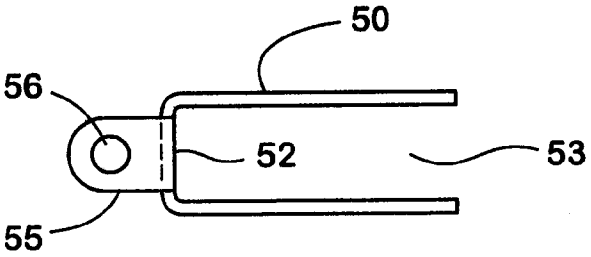
FIG. 17 is a top plan view of the bracket part of FIG. 10.
Figure 18:
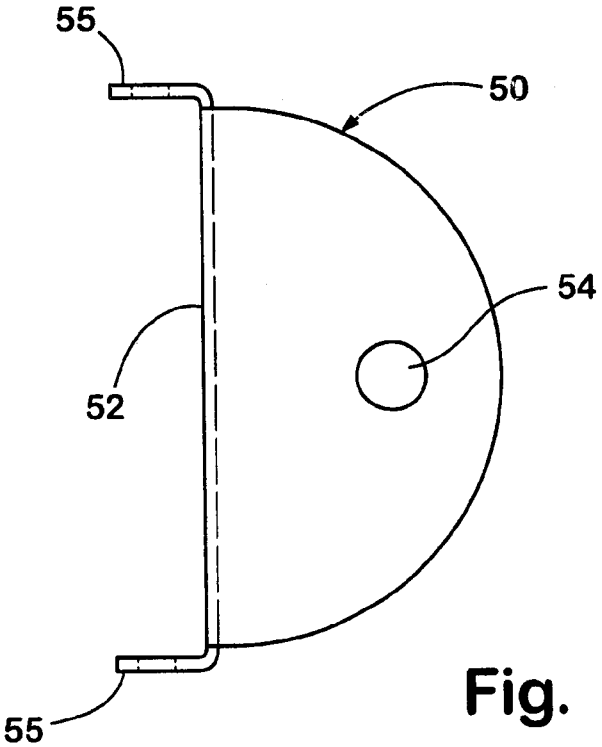
FIG. 18 is a front elevational view of the bracket part of FIG. 10.
Figure 16:
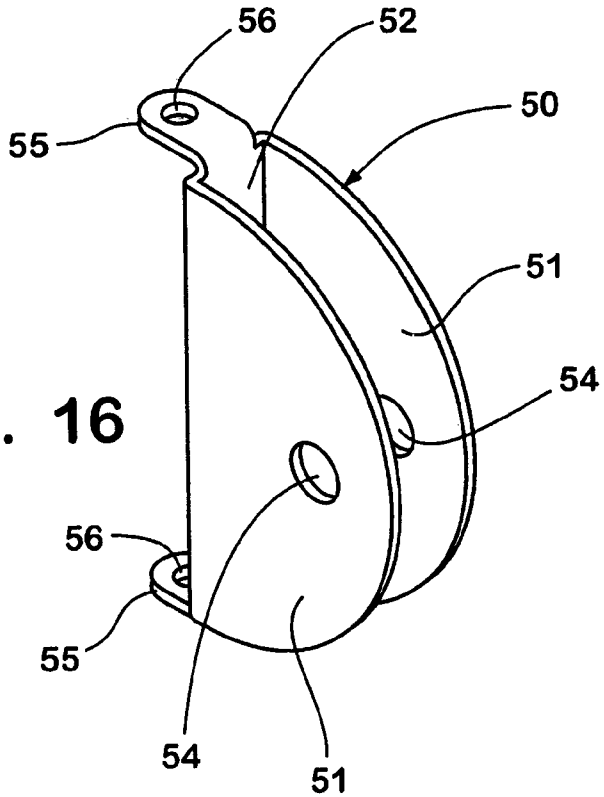
FIG. 16 is a perspective view of the part of the bracket of FIG. 10 that attaches to the side edge of the door.

The hinged bracket 38 also includes a second bracket member 50 illustrated in FIGS. 16–18. The bracket member 50 is formed from sheet metal, and includes a pair of spaced-apart parallel sidewalls 51, and a base wall 52 forming a U-shaped opening 53 that receives the side edge 9 of the sheet 8. Openings 54 in sidewalls 51 receive a conventional threaded fastener (not shown) that extends through the sheet 8 to securely interconnect the bracket 50 and sheet 8. A pair of tabs 55 extend horizontally from the base wall 52, and include openings 56 that receive hinge pin 44 to pivotally interconnect the second bracket member 50 and the brackets 39. Hinge pin 44 also interconnects the pair of brackets 39, forming an assembly that securely mounts the sheet 8 to the post 3.

The screen and door assemblies of the present invention can be quickly and easily connected to a partition system as required to meet the needs of a particular user. Furthermore, the screen and doors do not require modification of the partition system, such that removal of the screen or door does not result in unsightly modifications to the partition system. Furthermore, the beams of the partition system can be readily disconnected from the posts and moved to a new vertical position, such that the screen 1 of the present invention may be removed. The beam may then be shifted upwardly and covered by a standard cover panel to create a standard full-height panel. Alternately, the upper beam may be moved downwardly, and a screen 1 can then be installed in the resulting U-shaped opening through the partition panel to convert a full-height panel to a screened panel.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A screen assembly adapted to connect to a partition of the type having at least one upright frame member having openings in opposite side faces thereof that receive support hooks of hang-on accessory units, said screen assembly comprising:

a sheet member defining at least one side edge;

a bracket connected to said sheet member adjacent said side edge;

said bracket including a first member configured to extend around at least a portion of a first side face of the upright frame member, said first member including a first connector adapted to engage the openings in the first side face of the upright frame member; and said bracket including a second member configured to extend around at least a portion of a second side face of the upright frame member, said second member including a second connector adapted to engage the openings in a second side face of the upright frame member.

2. The screen assembly of claim 1, wherein:

said first connector includes a first hook configured to engage at least a selected one of the openings in a first side face of an upright frame member, and said second connector includes a second hook configured to engage at least a selected one of the openings in a second side face of an upright frame member.

3. The screen assembly of claim 2, wherein:

said side edge of said sheet member comprises a first side edge, said sheet member defining a second side edge, and wherein said bracket comprises a first bracket, and including a second bracket substantially identical to said first bracket connected to said sheet member adjacent said second side edge.

4. The screen assembly of claim 3, wherein:

said first and second members comprise generally flat webs, each defining a side edge having an orthogonal flange, said first and second hooks formed on edge portions of said flanges.

5. The screen assembly of claim 4, wherein:

said side edges of said flat webs comprise first side edges, and said webs defining second side edges spaced-apart from said first side edges, said flanges comprising first flanges, said webs further including second flanges spaced-apart from said first flanges and extending approximately parallel thereto, said second flanges having an end portion connected to said sheet member.

6. A screen assembly adapted to connect to a partition of the type having at least one upright frame member having openings in opposite side faces thereof that receive support hooks of hang-on accessory units, said screen assembly comprising:

a sheet member defining at least one side edge;

a bracket connected to said sheet member adjacent said side edge;

said bracket including a first member configured to extend around at least a portion of a first side face of the upright frame member, said first member including a first connector adapted to engage the openings in the first side face of the upright frame member;

said bracket including a second member configured to extend around at least a portion of a second side face of the upright frame member, said second member including a second connector adapted to engage the openings in a second side face of the upright frame member;

said first connector includes a first hook configured to engage at least a selected one of the openings in a first side face of an upright frame member, and said second connector includes a second hook configured to engage at least a selected one of the openings in a second side face of an upright frame member;

said side edge of said sheet member comprises a first side edge, said sheet member defining a second side edge, and wherein said bracket comprises a first bracket, and including a second bracket substantially identical to said first bracket connected to said sheet member adjacent said second side edge;

said first and second members comprise generally flat webs, each defining a side edge having an orthogonal flange, said first and second hooks formed on edge portions of said flanges;

said side edges of said flat webs comprise first side edges, and said webs defining second side edges spaced-apart from said first side edges, said flanges comprising first flanges, said webs further including second flanges spaced-apart from said first flanges and extending approximately parallel thereto, said second flanges having an end portion connected to said sheet member, wherein:

said end portions of said second flanges extend parallel to said sheet member and have an opening through said end portion; and including:

a fastener extending through said opening and securing said sheet member to said bracket.

7. The screen assembly of claim 6, wherein:

said sheet member is a lightweight opaque material.

8. The screen assembly of claim 1, wherein:

said sheet member is pivotably connected to said bracket to form a door.

9. The screen assembly of claim 8, wherein:

said bracket includes a pair of spaced-apart flat portions, said side edge of said sheet member received between said flat portions.

10. A knock-down portable partition, comprising:

a partition frame including:

a pair of spaced-apart vertical posts, each having a pair of opposed side faces and a vertical row of openings in a selected one of said side faces for supporting hang-on accessory units;

upper and lower beams extending between said posts and rigidly yet releasably interconnecting the same to form a rigid panel frame that can be quickly and easily assembled and disassembled, said partition frame defining a pair of horizontally spaced parallel, vertical planes coincident with at least a portion of said side faces;

a screen assembly connected to a first one of said posts, said screen assembly including:

a screen member defining at least one side edge; and a bracket having a screen-engaging portion that supports said screen, said bracket having at least one connector, said connector engaging said row of openings in said post and supporting said screen adjacent said post, said bracket extending around said post such that said screen-engaging portion of said bracket is positioned between said vertical planes.

11. The knock-down portable partition of claim 10, wherein:

said bracket includes at least one hook received within a selected one of said openings in said post to support said bracket.

12. A knock-down portable partition, comprising:

a partition frame including:

a pair of spaced-apart vertical posts, each having a first vertical row of openings in a side face for supporting hang-on accessory units, each post including a second row of openings in an opposite side face;

upper and lower beams extending between said posts and rigidly yet releasably interconnecting the same to form a rigid panel frame that can be quickly and easily assembled and disassembled;

a screen assembly connected to a first one of said posts, said screen assembly including:

a screen member defining at least one side edge; and a bracket having at least one connector, said connector engaging said row of openings in said post and supporting said screen adjacent said post, said bracket including at least one hook received within a selected one of said openings in said first vertical row of openings in said post to support said bracket;

said bracket including a second hook received within a selected one of said openings in said second row of openings in said post.

13. The knock-down portable partition of claim 12, wherein:

said bracket includes a pair of spaced-apart parallel webs, said webs having a first flange extending orthogonally therefrom and forming said hooks.

14. The knock-down portable partition of claim 13, wherein:

said screen is pivotably connected to said bracket to form a door.

15. The knock-down portable partition of claim 14, wherein:

said hooks include an upwardly opening portion, and a downwardly opening portion.

16. A knock-down portable partition, comprising:

a partition frame including:

a pair of spaced-apart vertical posts, each having a pair of opposed side faces and a vertical row of openings in a selected one of said side faces for supporting hang-on accessory units;

upper and lower beams extending between said posts and rigidly yet releasably interconnecting the same to form a rigid panel frame that can be quickly and easily assembled and disassembled, said partition frame defining a pair of horizontally spaced parallel, vertical planes coincident with at least a portion of said side faces;

a screen assembly connected to a first one of said posts, said screen assembly including:

a screen member defining at least one side edge; and a bracket having at least one connector, said connector engaging said row of openings in said post and supporting said screen between said vertical planes adjacent said post.

* * * * *